US010696362B1

(12) United States Patent
Stadie

(10) Patent No.: US 10,696,362 B1
(45) Date of Patent: Jun. 30, 2020

(54) INTEGRATED KAYAK COOLER

(71) Applicant: Andreas Stadie, Bon Aqua, TN (US)

(72) Inventor: Andreas Stadie, Bon Aqua, TN (US)

( * ) Notice: Subject to any disclaimer, the term of this patent is extended or adjusted under 35 U.S.C. 154(b) by 0 days.

(21) Appl. No.: 16/005,760

(22) Filed: Jun. 12, 2018

Related U.S. Application Data

(60) Provisional application No. 62/518,169, filed on Jun. 12, 2017.

(51) Int. Cl.
*B63B 34/20* (2020.01)
*B63B 34/26* (2020.01)

(52) U.S. Cl.
CPC ..... *B63B 34/20* (2020.02); *B63B 34/26* (2020.02)

(58) Field of Classification Search
CPC ..... B63B 35/71; B63B 2035/715
See application file for complete search history.

(56) References Cited

U.S. PATENT DOCUMENTS 4,398,488 A * 8/1983 Mathieu ..... B63B 17/00 114/343
6,793,106 B1 * 9/2004 Kerry ..... B63B 25/00 114/347
6,840,190 B2 * 1/2005 Godek ..... A45C 11/20 114/347
7,032,531 B1 * 4/2006 Caples ..... B63B 19/14 114/347
7,230,291 B2 * 6/2007 Kim ..... H01L 28/65 257/295
2006/0032422 A1 * 2/2006 McDermott ..... B63B 25/00 114/256
2007/0012236 A1 * 1/2007 Caples ..... B63B 19/16 114/347

OTHER PUBLICATIONS

Hobie Fish Bags and Soft Coolers, https://www.hobie.com/accessories/fish-bags-coolers/ (Year: 2017).*

* cited by examiner

*Primary Examiner* — Anthony D Wiest
(74) *Attorney, Agent, or Firm* — Matthew M. Googe; Robinson IP Law, PLLC

(57) ABSTRACT

An integrated kayak cooler includes: a hollow cooler body tapering from an end adjacent to a kayak seat to a narrower end adjacent an end of the kayak and shaped to conform to a shape of a hull of the kayak; a cooler recess formed on an upper surface of the cooler body, the cooler recess aligned with a cooler access formed in a deck of the kayak; and an insulating material located in a space between the cooler recess and the cooler body and within the hollow cooler body. The integrated kayak cooler is located within the kayak between the deck and the hull of the kayak.

7 Claims, 4 Drawing Sheets

INTEGRATED KAYAK COOLER

CROSS-REFERENCE TO RELATED APPLICATION

This application claims priority to U.S. provisional patent application Ser. No. 62/518,169 for an "Integrated Kayak Cooler" filed on Jun. 12, 2017, the contents of which are incorporated herein by reference in its entirety.

FIELD

This disclosure relates to the field of kayaks and similar watercraft. More particularly, this disclosure relates to a kayak having an integrally formed cooler and storage area.

BACKGROUND

Kayaks are small watercraft propelled by a user paddling through water. Unlike a canoe, a kayak typically includes a covered deck area and a cockpit that prevents entry of water into a space between the deck and hull. Kayaks are typically long and narrow, and it is often difficult to carry additional items such as coolers. A user must typically strap a cooler to the deck of the kayak or otherwise find a suitable location to stow the cooler. However, when a user straps a cooler to the deck of the kayak, the kayak may become less stable. Further, if the kayak capsizes, items from the cooler may spill into the water and be lost.

Various attempts have been made to transport coolers on kayaks. For example, attempts have been made to allow placement of a cooler on the deck of the kayak. Similarly, storage compartments may be used to store various items including ice and beverages. These attempts suffer several shortcomings including lack of stability, lack of insulation, and otherwise reducing usability of the kayak.

What is needed, therefore, is an integrated kayak cooler that insulates items in the cooler while improving stability of the kayak.

SUMMARY

The above and other needs are met by an integrated kayak cooler for installation within a kayak. In a first aspect, an integrated kayak cooler includes: a hollow cooler body tapering from an end adjacent to a kayak seat to a narrower end adjacent an end of the kayak and shaped to conform to a shape of a hull of the kayak when installed in a kayak; a cooler recess formed on an upper surface of the cooler body, the cooler recess aligned with an access formed in a deck of the kayak.

In one embodiment, the integrated kayak cooler further includes an insulating material located in a space between the cooler recess and the cooler body and within the hollow cooler body.

In another embodiment, the integrated kayak cooler is shaped to fit within the kayak between the deck and the hull of the kayak when the cooler is installed in the kayak. In another embodiment, the integrated kayak cooler further includes a lid hingedly attached to the deck of the kayak over the cooler recess. In yet another embodiment, the integrated kayak cooler further includes one or more latches attached between the lid and a deck of the kayak.

In one embodiment, an upper surface of the hollow cooler body is flush with an underside of a deck of the kayak when the integrated kayak cooler is installed in the kayak.

In another embodiment, the integrated kayak cooler is fastened to a deck of the kayak with one or more fasteners when installed in the kayak. In yet another embodiment, the integrated kayak cooler is secured within the kayak with an adhesive.

In one embodiment, the integrated kayak cooler further includes a lip formed around the cooler recess shaped to engage the lid hingedly attached to the deck of the kayak.

In a second aspect, an integrated kayak cooler includes: a hollow cooler body tapering from an end adjacent to a kayak seat to a narrower end adjacent an end of the kayak and shaped to conform to a shape of a hull of the kayak; a cooler recess formed on an upper surface of the cooler body, the cooler recess aligned with a cooler access formed in a deck of the kayak; and an insulating material located in a space between the cooler recess and the cooler body and within the hollow cooler body. The integrated kayak cooler is located within the kayak between the deck and the hull of the kayak.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
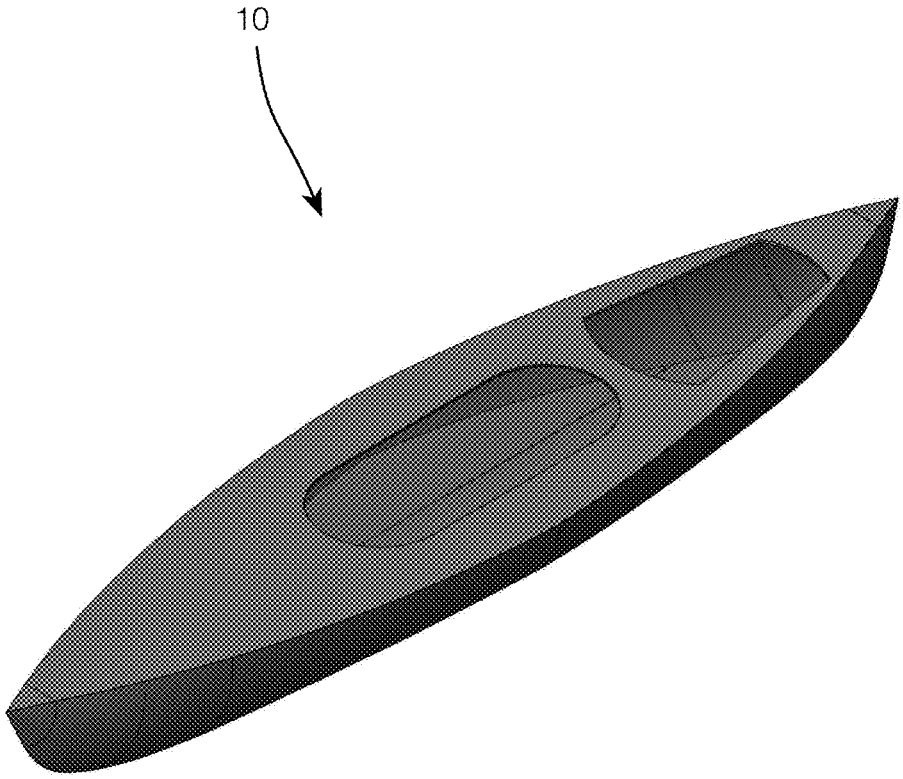
FIG. 1 shows a kayak having an integrated cooler according to embodiments of the present disclosure.

FIG. 1 shows a kayak 10 according to one embodiment of the present disclosure. The kayak 10 is preferably constructed from polyethylene, fiberglass, wood, or other like materials. The kayak 10 is preferably a recreational kayak for use in a variety of activities, however it is also understood that the kayak may be a sea kayak, white water kayak, and other various types of kayaks.

Figure 2:
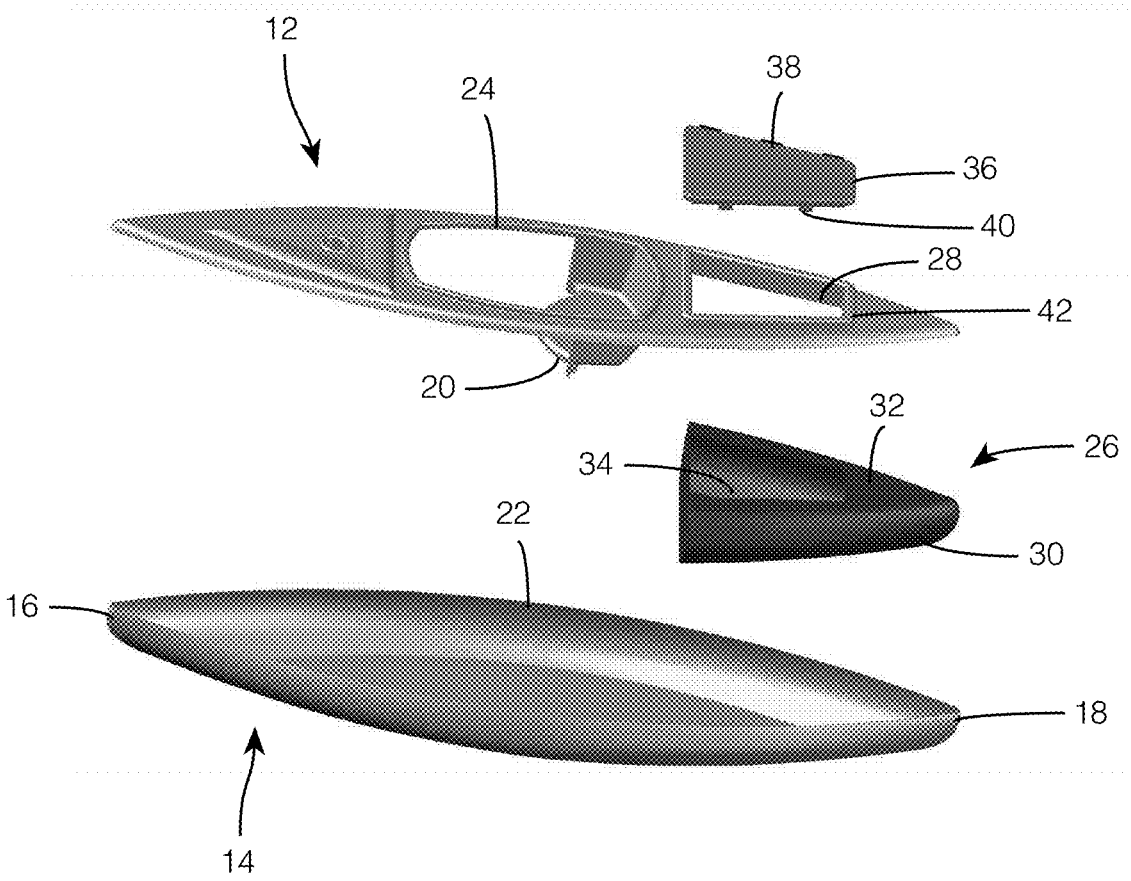
FIG. 2 shows an exploded view of a kayak having an integrated cooler according to one embodiment of the present disclosure.
Figure 3:
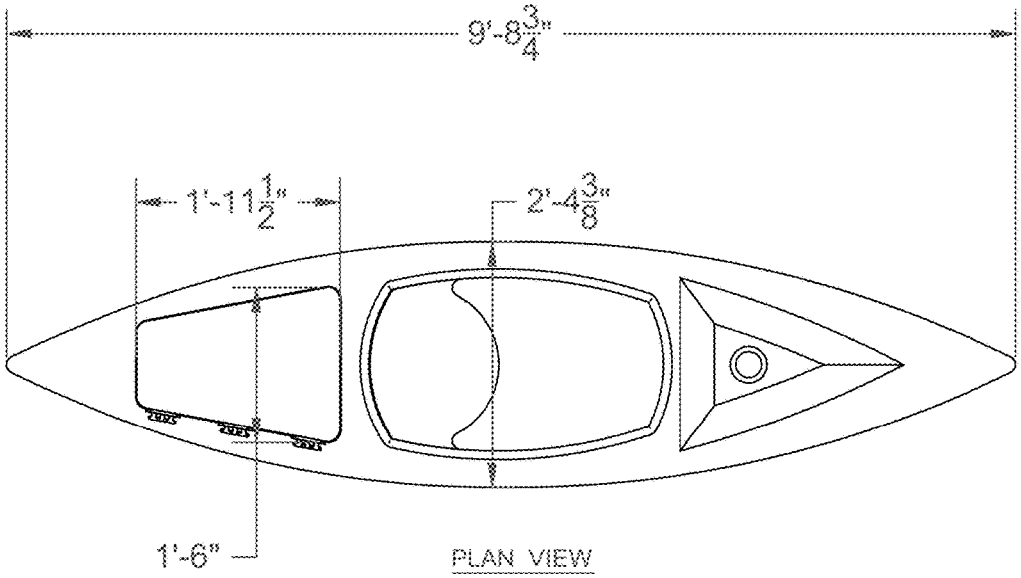
FIG. 3 shows a top view of a kayak having an integrated cooler according to one embodiment of the present disclosure.
Figure 4:
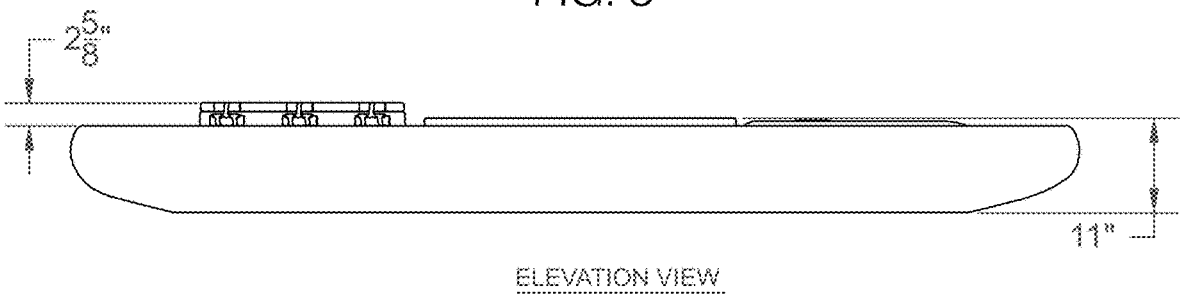
FIG. 4 shows a side view of a kayak having an integrated cooler according to one embodiment of the present disclosure.

Referring to FIG. 2, the kayak 10 is formed of an upper kayak deck 12 that is joined with a lower kayak hull 14. The kayak 10 includes a tapered bow portion 16 and a tapered stern portion 18. A seat 20 is formed in the kayak 10 at a middle portion 22 of the kayak 10. As shown in FIG. 2, the seat 20 may be formed as part of the kayak deck 12 and includes a cockpit portion 24 formed through the kayak deck 12. The kayak 10 is substantially hollow between the kayak deck 12 and the hull 14 such that when a user is seated in the seat, the user's legs extend into the bow portion 16 of the kayak 10 between the kayak deck 12 and hull 14.

A kayak cooler 26 is shaped to fit between the upper kayak deck 12 and lower kayak hull 14 and is preferably located adjacent stern portion 18 of the kayak 10. The kayak cooler 26 is accessible through a cooler access 28 formed through the kayak deck 12. The kayak cooler 26 includes a cooler body 30 shaped to conform to an inner surface of the tapered stern portion 18 of the kayak hull 14. The cooler body 30 includes an upper surface 32 that is shaped to conform to an underside of the kayak deck 12 and is preferably flush with an underside of the kayak deck 12. A cooler recess 34 is formed in the cooler body 30 and is shaped to receive various cooler items such as ice, beverages, food, and other like items. The cooler body 30 extends from a tapered end adjacent the stern portion 18 of the kayak 10 to an end adjacent to the seat 20 of the kayak 10.

Figure 5:
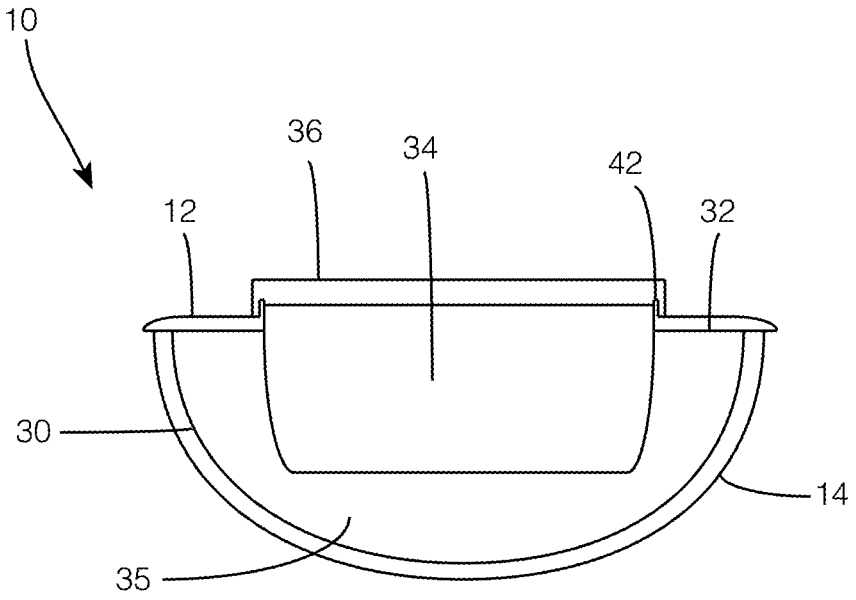
FIG. 5 shows a cross-sectional lengthwise view of a kayak having an integrated cooler according to one embodiment of the present disclosure.

A space 35 (FIG. 5) is defined between walls of the cooler recess 34 and the cooler body 30. An insulating material is preferably located within the space between the walls of the cooler recess 34 and the cooler body 30 such that the cooler recess 34 is substantially insulated. For example, an insulation such as pressure injected polyurethane foam or other like insulating materials is located in the space between the cooler recess 34 and the cooler body.

The cooler recess 34 is aligned with the cooler access 28 formed in the upper kayak deck 12 when the kayak cooler 26 is located within the kayak 10 such that items may be placed into or removed from the kayak cooler 26 through the cooler access 28. A lid 36 is hingedly attached to the upper kayak deck 12 with a hinge 38. One or more latches 40 may be formed on the lid 36 such that the lid 36 may be secured in a closed position. The lid 36 fits around a lip 42 formed on the upper kayak deck 12 and forms a water-tight seal between the lid 36 and the cooler recess 34 to prevent water from entering the cooler recess 34.

The kayak cooler 26 is placed within the kayak 10 between the upper kayak deck 12 and the hull 14 such that the kayak cooler 26 is integrated with the kayak 10. The cooler 26 is preferably installed in the kayak 10 during construction of the kayak 10 between the upper deck 12 and hull 14. In one embodiment, the kayak cooler 26 is fastened to the upper deck 12 with one or more fasteners. When the upper deck 12 and attached kayak cooler 26 are joined to the hull 14, the kayak cooler 26 is fixed between the upper deck 12 and hull 14. Alternatively, the kayak cooler 26 may be secured to the hull 14, such as with an adhesive or with fasteners, and the upper deck 12 may be joined to the hull 14 on top of the kayak cooler 26.

The kayak cooler 26 advantageously integrates a storage area for items that a user desires to be kept cold into a kayak 10 without substantially compromising stability of the kayak 10 and while improving an ability of the cooler to maintain items at a colder temperature. The insulated cooler recess 34 maintains cold items within the kayak cooler 26. Alternatively, a user may store items within the kayak cooler 26 such that the items remain dry due to the water-tight configuration of the kayak cooler 26.

The kayak cooler 26 also enhances buoyancy of the kayak 10. The insulation, which is preferably an injected foam or other like material, is buoyant and thereby aids in maintaining buoyancy of a portion of the kayak 10 where the cooler 26 is located. For example, when the cooler 26 is located at the stern portion of the kayak, the stern portion may maintain buoyancy despite water otherwise entering the kayak between the upper deck 12 and the hull 14.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An integrated kayak cooler comprising:

a rigid hollow cooler body tapering from an end adjacent to a kayak seat to a narrower end adjacent an end of the kayak and shaped to conform to a shape of a hull of the kayak when installed in a kayak;

a cooler recess formed on an upper surface of the cooler body, the cooler recess aligned with an access formed in a deck of the kayak;

an insulating material located in a space between the cooler recess and the cooler body and within the hollow cooler body;

a lid hingedly attached to the deck of the kayak over the access formed in the deck of the kayak;

wherein opening of the lid provides access to items within the cooler recess and wherein the lid provides a sealing closure of the cooler recess over the access formed in the deck of the kayak.

2. The integrated kayak cooler of claim 1, wherein the integrated kayak cooler is shaped to fit within the kayak between the deck and the hull of the kayak when the cooler is installed in the kayak.

3. The integrated kayak cooler of claim 1, further comprising one or more latches attached between the lid and a deck of the kayak.

4. The integrated kayak cooler of claim 1, wherein an upper surface of the hollow cooler body is flush with an underside of a deck of the kayak when the integrated kayak cooler is installed in the kayak.

5. The integrated kayak cooler of claim 1, wherein the integrated kayak cooler is fastened to a deck of the kayak with one or more fasteners when installed in the kayak.

6. The integrated kayak cooler of claim 1, wherein the integrated kayak cooler is secured within the kayak with an adhesive.

7. The integrated kayak cooler of claim 1, further comprising a lip formed around an upper surface of the cooler recess shaped to engage the lid hingedly attached to the deck of the kayak such that the lid seals the cooler recess around the lip when closed.

* * * * *